US005675993A

United States Patent [19]

Ono et al.

[11] Patent Number: 5,675,993

[45] Date of Patent: Oct. 14, 1997

[54] PATTERNING METHOD AND DEVICE IN WARP KNITTING MACHINE

[75] Inventors: Kotaro Ono; Yoshinori Otobe; Yoshitsugu Kobayashi; Shigeo Yamagata; Norimasa Nosaka, all of Fukui; Kenji Sumida, Tochigi, all of Japan

[73] Assignee: Nippon Mayer Co. Ltd., Fukui, Japan

[21] Appl. No.: 522,273

[22] PCT Filed: Jan. 13, 1995

[86] PCT No.: PCT/JP95/00032

§ 371 Date: Oct. 30, 1995

§ 102(e) Date: Oct. 30, 1995

[87] PCT Pub. No.: WO95/19462

PCT Pub. Date: Jul. 20, 1995

[30] Foreign Application Priority Data

| | | | |
|---|---|---|---|
| Jan. 14, 1994 | [JP] | Japan | 6-015884 |
| Aug. 5, 1994 | [JP] | Japan | 6-184656 |
| Aug. 25, 1994 | [JP] | Japan | 6-200750 |

[51] Int. Cl.[6] ..... D04B 27/26

[52] U.S. Cl. ..... 66/204; 66/205; 66/207

[58] Field of Search ..... 66/204, 205, 207

[56] References Cited

U.S. PATENT DOCUMENTS

| | | | |
|---|---|---|---|
| 3,978,690 | 9/1976 | Beling et al. | 66/205 |
| 4,051,698 | 10/1977 | Leonhardt | 66/205 |
| 5,140,841 | 8/1992 | Offermann et al. | 66/207 |
| 5,241,842 | 9/1993 | Hagel | 66/204 |
| 5,327,750 | 7/1994 | Speich | 66/207 |
| 5,390,513 | 2/1995 | Hagel et al. | 66/207 |

FOREIGN PATENT DOCUMENTS

| | | | |
|---|---|---|---|
| 0580009 | 10/1992 | European Pat. Off. | 66/204 |
| 6-49754 | 2/1994 | Japan . | |

*Primary Examiner*—John J. Calvert

*Attorney, Agent, or Firm*—Jordan and Hamburg

[57] ABSTRACT

A patterning method and device has yarn guides for guiding pattern yarns in a warp knitting machine and divisional fall plates for knitting pattern yarns in a fall plate structure individually drive-controlled through drive devices. The device comprises any number of moveable bodies having yarn guides, the bodies being installed for movement along a row of knitting needles by the drive devices. For patterning, the moveable bodies are moved through a desired distance along the row of knitting needles so as to be positioned for patterning, thereby providing a patterning zone for pattern yarns corresponding to the number of yarn guides. Thus, it is possible to effect a free varigated patterning which is comparable with the patterning effect provided by the Jacquard control. Further, it possible to attain the knitting of a fall plate structure, in addition to the patterning by the aforesaid yarn guides, by moving any number of the moveable bodies having yarn guides and/or any number of moveable bodies having divisional fall plates by the drive devices to produce a fall plate-like action, without requiring a device of large scale.

11 Claims, 8 Drawing Sheets

PATTERNING METHOD AND DEVICE IN WARP KNITTING MACHINE

BACKGROUND OF THE INVENTION

The present invention relates to a patterning method and device wherein patterning is effected by yarn guides for guiding pattern yarns in a warp knitting machine and fall plates for knitting pattern yarns in a fall plate structure that are individually drive-controlled through drive means.

BACKGROUND ART

As for means for guiding knitting yarns in a warp knitting machine, there are a ground guide bar for guiding ground yarns and a pattern guide bar for guiding pattern yarns. At present, a knitting machine has been developed which has about 80 pattern guide bars, and the development of a knitting machine having a greater number of pattern guide bars has been desired for colorful patterning comparable with Jacquard control; however, there is a problem of limited installation space and hence acceptance has not been realized.

On the other hand, the present applicant has proposed an arrangement in Japanese Patent Kokai Hei 6-49754, wherein a linear motor is directly connected to a yarn guide bar in a warp knitting machine, the movable element of the motor being fixed to the yarn guide bar, thereby controlling the drive of the yarn guide bar.

According to this proposal, although the pattern guide bar, which is a kind of yarn guide bar, having yarn guides mounted thereon for guiding pattern yarns can be driven by directly connecting a linear motor thereto, the fact remains unchanged that all the yarn guides mounted on a single pattern guide bar make the same movement; thus, it is still necessary to increase the number of pattern guide bars in order to provide a colorful pattern. However, it is very difficult from the standpoint of space and it does not pay to mount 100 or more pattern guide bars.

SUMMARY OF THE INVENTION

An object of the present invention is to provide a patterning method and device for a warp knitting machine, which completely changes the concept of conventional drive control of pattern guide bars, wherein patterning devices which can be freely drive-controlled on a pattern guide bar line are installed on individual yarn guides, thereby making it possible to effect free patterning using yarn guides which is comparable with the patterning effect provided by Jacquard control. Another object is to provide a patterning method and device for a warp knitting machine having fall plates, wherein free patterning using yarn guides is possible while the knitting of fall plate structure is also possible.

Further, in a conventional warp knitting machine having fall plates, the knitting of so-called fall plate structure is effected by moving float pattern yarns to be introduced by a float pattern guide bar by actuating stitch forming position of knitting needles to the non-stitch forming position, so that the float pattern yarns are fixed as a float pattern on the back of the knitted fabric; however, since the fall plate is actuated at a time over the entire row of knitting needles, the fall plate is in the form of a single plate extending along the row of knitting needles.

In this warp knitting machine, the fall plate acts simultaneously over the entire width of the knitting machine; therefore, as in the case of simultaneously producing a plurality of knitted fabrics, when it is desired to knit a pattern arrangement which has a plurality of knitting widths and which varies for each width, for example a sink pattern alone or a partial float pattern, the fall plate has to act for each course, with the result that the vibration of the knitting machine is fostered and a large-scale device such as a cam or lever is required.

Thus, a further object of the invention is to provide a patterning method and device for a warp knitting machine, which eliminates the aforesaid drawback and which, without requiring a large-scale device, is capable of effecting the fall plate action for each knitting width, and makes it possible to select the fall plate action in necessary courses.

The present invention provides a patterning method and device for a warp knitting machine which effect patterning by guiding pattern yarns to a row of knitting needles through yarn guides, having the following features.

The patterning method of the present invention is characterized in that an arbitrary number of movable bodies each having at least a portion thereof constructed as a yarn guide are installed so that they are movable along a predetermined guide path on the basis of driving means, and in patterning, the movable bodies having the yarns guides are positioned by being moved by a desired amount of displacement along the row of knitting needles, whereby patterning is effected.

Further, the patterning device of the present invention is characterized in that it comprises movable bodies having the yarn guides, a guide path extending along the row of knitting needles for moving the movable bodies, and driving means for moving the movable bodies along the guide path in an arbitrary direction by a desired amount of displacement.

According to such patterning method and device, the respective yarn guides of the movable bodies are capable of individually making different movements as each is moved in an arbitrary direction by a desired amount of displacement on the line defined by the guide path along the row of knitting needles. Therefore, by juxtaposing these movable bodies having yarn guides, it is possible to increase the patterning effect of pattern yarns to be guided to many times the patterning effect provided by the use of conventional pattern guide bars.

Further, if a yarn single movable body having a guide is installed in the guide path extending along the row of knitting needles, the amount of displacement of the movable body, i.e., the yarn point can be increased, whereby the swing width on the knitted fabric of a single yarn to be guided can be increased, making possible the knitting of a more complex pattern.

In this connection, it is to be noted that the guide path includes at least one such path disposed along the row of knitting needles and having a length substantially corresponding to the width of a warp knitting machine, and a plurality of such paths each divided at two or more places.

As for the driving means for the movable bodies having the yarn guides, use may be made, of a magnetic drive body, such as a linear motor, rotary motor or solenoid, which utilizes compressed fluid, such as an air jet, or means using a piezoelectric or electrostrictive element. Such driving means capable of displacing the movable body and being controlled on the basis of a signal from an electronic or mechanical control section is particularly suitable. Other driving means may be used provided that it can be controlled in the same manner as described above. Further, mechanical driving means which are capable of displacing the movable body and which are controlled may also be used.

In the aforesaid patterning device, the guide path is defined by the movable body holding member disposed parallel with the row of knitting needles, and it is possible to make an arrangement in which a plurality of movable bodies are disposed in the same guide path.

In this case, effective use of the installation space for the device is possible, and directions of movement and amounts of displacements can be respectively set for a plurality of movable bodies disposed in the guide path defined by a single holding member. Thus, the yarn guides carried by the movable bodies individually make different amounts of displacement for one course, providing a variation of pattern yarns whose number is equal to the number of installed holding members multiplied by the number of yarn guides. Thus, this arrangement can be effectively used to form a transversely taken large-sized-pattern curtain.

Further, the arrangement in which the holding member is fixed on one hand and on the other hand the small-sized light-weight movable bodies having yarn guides mounted thereon are allowed to move, alleviates vibration and noise caused by the conventional guide bar serving as the holding member.

Further, in the aforesaid patterning device, it may be arranged that at least a portion of each of the movably body holding members disposed along the row of knitting needles is constructed as the stator of a linear motor and a yarn guides is fixed to the movable body formed as a movable element movable with respect to the stator. This arrangement does not require a large-scale moving means and further simplifies the construction and saves space.

Further, in the patterning device, it may be arranged that the yarn guides is attached to a rotary motor forming at least part of the movable body or is operatively connected to the rotary motor through another member and that the movable body moves by a desired amount of displacement according to the rpm or rotary angle of the rotor of the motor. In this case, the movement and stoppage of the movable body can be controlled by controlling the driving of the motor.

In each of the arrangements of the patterning device, it is desirable that the amount of displacement of the movable body be ensured by a stop member which can be actuated for each knitting gauge. This makes the positioning of the yarn guide more reliable. It is possible to use a piezoelectric element as a component of the stop member.

According to another patterning method of the present invention which effects patterning by introducing pattern yarns to a row of knitting needles through yarn guides carried on the movable bodies, an arbitrary number of movable bodies each having at least a portion thereof constructed as a yarn guide and/or an arbitrary number of movable bodies each having at least a portion thereof constructed as a divisional fall plate corresponding to a portion of the row of knitting needles are installed so that they can perform the fall plate-like action on the basis of the driving means, and in the patterning operation, part or all of the movable bodies are moved toward a portion of the row of knitting needles by a desired amount of displacement to perform a fall plate-like action.

Further, the patterning device comprises the movable body having a yarn guide and/or said movable body having a divisional fall plate capable of knitting of fall plate structure, a guide path for moving the movable bodies, and driving means for moving the movable bodies in the guide path in an arbitrary direction by a desired amount of displacement.

According to the thus arranged patterning method and device, as described above, free and colorful patterning is made possible by the yarn guides movable along the row of knitting needles, and the knitting of fall plate structure is made possible for an arbitrary course by selectively moving the, yarn guides and/or part or all of the divisional fall plates toward a portion of the row of knitting needles. Therefore, it is possible to obtain a knitted fabric, such as lace fabric, which has a more gorgeous external appearance resulting from the formation of a fall plate structure at arbitrary knitting positions, in addition to the patterning effect provided by the yarn guides.

In the case where the fall plate-like action is to be performed by the movable body having a yarn guide, there are two guide paths for moving it, one for moving it along the row of knitting needles and the other for moving it toward the row of knitting needles.

In addition, for the movable body having a divisional fall plate, like the movable body having yarn guide, it is preferable that the fall plate action be performed after it is arranged that the movable body holding members disposed along the row of knitting needles are used to define a guide path to allow the movable body to move along the row of knitting needles on the basis of the driving means. In this case, in a single guide path along the row of knitting needles, a plurality of movable bodies having divisional fall plates may be disposed at intervals which allowed the movement or alternatively only a single movable body may be disposed. Thereby, the arrangement, which is capable of knitting of fall plate structure, can be simplified much more than the one having fall plates having a length corresponding to the width of the conventional knitting machine.

Further, a fall plate may be divided to provide divisional fall plates each having a predetermined longitudinal dimension, the divisional fall plates being adapted to be movable only toward the row of knitting needles by their respectively movable bodies and being selectively actuated to perform fall plate action. In this case, the arrangement for moving them along the row of knitting needles is unnecessary.

Further, for the driving means for the movable body having the divisional fall plate, use may be made, as in the previous invention, of a magnetic driving body, such as a linear motor and a rotary motor, means utilizing compressed fluid, means using a piezoelectric or electrostrictive element, or other electronically or mechanically controllable driving means. Further, when the movable body holding member is formed as a guide path, a portion of the holding member may be constructed as the stator of a linear motor, while the movable body movable with respect to the stator may have a divisional fall plate fixed thereto.

A further patterning method for a warp knitting machine according to the present invention guiding pattern yarns to a row of knitting needles through yarn guides and effecting the knitting of fall plate construction using at least part of the pattern yarns is characterized in that an arbitrary number of movable bodies each having at least a portion thereof constructed as a divisional fall plate corresponding to a portion of the row of knitting needles are disposed to be movable along a predetermined guide path in an arbitrary direction on the basis of the driving means and in that in patterning, the divisional fall plate of the movable body is moved in an arbitrary direction by a desired amount of displacement to be thereby positioned for fall plate action, so as to effect patterning.

Further, a patterning device corresponding to the patterning method comprises a movable body having the divisional fall plate, a guide path for moving the movable body to effect fall plate action, and driving means for moving the movable body along the guide path in an arbitrary direction by a desired amount of displacement.

According to the patterning method and device of this invention, the yarn guides pattern yarns in the same manner as in the prior art, while the divisional fall plates locally act for each of a plurality of knitting widths which are simultaneously knitted or for only one width; furthermore, they can selectively act for suitable courses, therefore, the fall plate action is effected for pattern arrangement of a partial float pattern in the course direction and/or knitting width direction, and since the action of the fall plate takes place only at the necessary places, vibration is mitigated, a large-scale device is not required, noise is reduced and the knitting of fall plate structure can be efficiently effected. As for the divisional fall plates in this invention, as in the previous invention, it can be arranged that a number of divisional fall plates into which a fall plate has been divided are disposed to be moved respectively by the movable bodies only toward a portion of the row of knitting needles to effect fall plate action or that one or a plurality of spaced divisional fall plates are disposed to be moved along the row of knitting needles to effect fall plate action. Further, as for the guide path for their movement and driving means for their movement, as in the previous invention, use may be made, of magnetic driving body, such as a linear motor and a rotary motor, means utilizing compressed fluid, means using a piezoelectric or electrostrictive element, or many other electronically or mechanically controllable driving means.

Further, in the patterning method and device in each invention, it may be arranged that an electronic or mechanical control section is provided for sending signals to the driving means, and on the basis of such signals from the electronic or mechanical control section to displace movable bodies, the movable body having a yarn guides and/or the movable body having a divisional fall plate is moved for positioning to effect patterning.

With such arrangement, the displacements of the individual yarn guides can be controlled by signals from the control section, such control being suitably made for underwrap and overwrap.

DETAILED DESCRIPTION OF THE INVENTION

The present invention will now be described with reference to the drawings.

Figure 1:
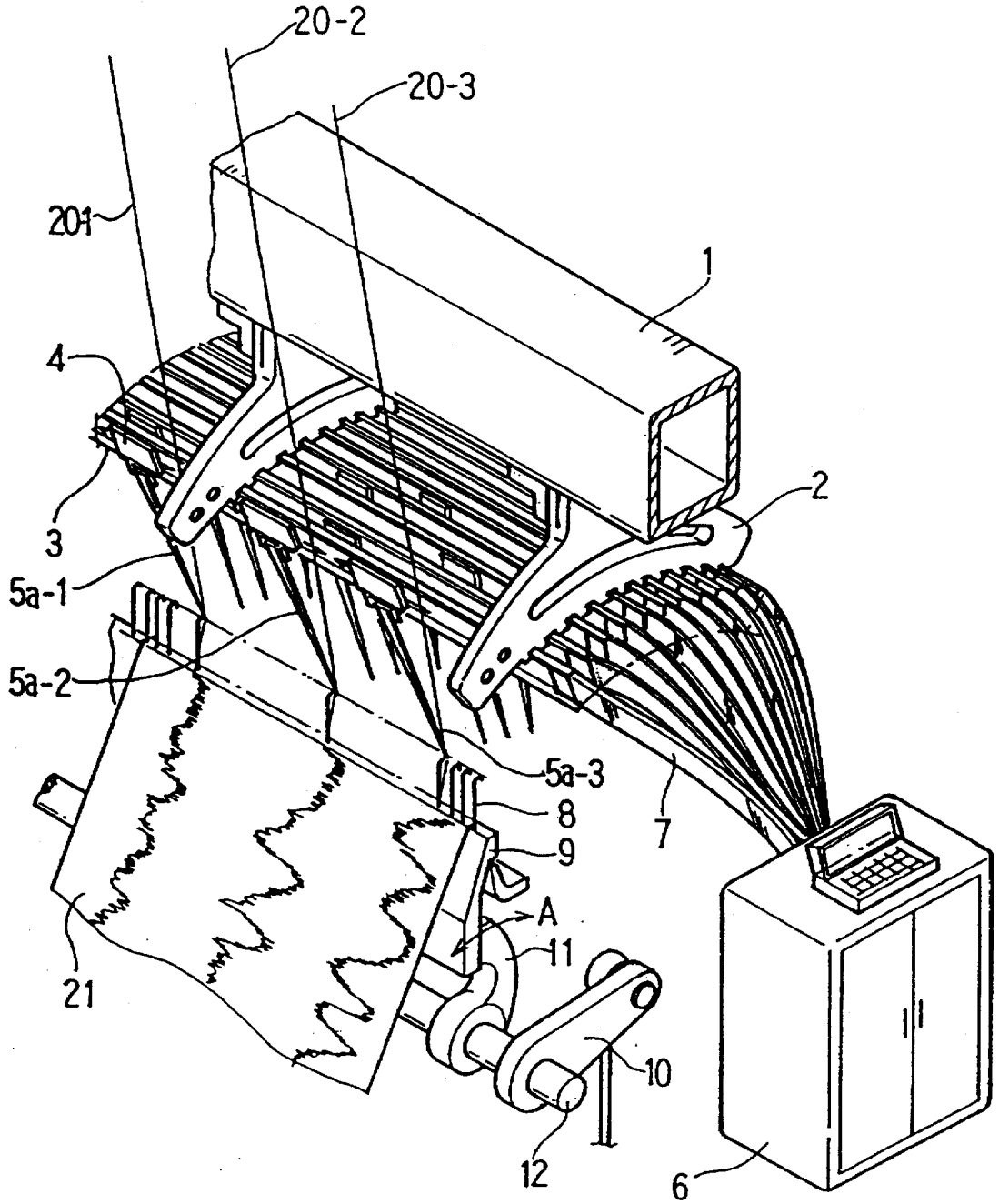
FIG. 1 is a schematic perspective view showing an embodiment of a patterning device in a warp knitting machine according to the present invention.

FIG. 1 is a schematic perspective view of a warp knitting machine, showing by way of example an embodiment of a patterning method and device according to the invention. In the figure, the numeral 1 denotes a traverse which is part of the machine frame, and 2 denotes hangers suspended from and fixed to the traverse 1 and disposed in a plurality of places at required intervals. The numeral 3 denotes movable body holding members each having at least a portion thereof constructed as the stator of a linear motor, the members being in the form of bars extending widthwise of the knitting machine, the required number of such members being fixed side by side to said hangers 2. The numeral 4 denotes movable elements linearly movable back and forth on the holding members 3, each of said movable elements having a yarn guides **5*a*-1, 5*a*-2, 5*a*-3 attached thereto, this assembly forming a movable body having a yarn guides. The movable elements 4, usually several to 10-odd in number, are attached widthwise of the knitting machine to the movable body holding members 3 each having a portion thereof constructed as the stator, so that the movable elements are movable according to a patterning program. Therefore, it follows that yarn guides for the movable elements 4 are defined along the holding members 3**.

The numeral 6 denotes an electronic control section for feeding electric control signals to driving means to be later described, the control section 6 having contained therein known control units, i.e., a position control circuit, linear motor driving circuit, an encoder and a pattern computer with memory; their arrangements are known and hence a description thereof is omitted. The electric control signals include a wireless electric wave signal.

Each holding member 3 is directly connected at one end thereof to a cable 7 which is one of the signal transmitting means. The numeral 8 denotes knitting needles; 9 denotes a trick plate; and 10 and 11 are a lever and an arm, respectively, for driving the trick plate 9, the lever and arm being mounted on a support shaft 12. The trick plate 9 is swung together with the knitting needles 8 in the direction of arrow A. As for the knitting needles 8, use may be made of conventional knitting needles, such as composite needles, latch needles, and beard needles and besides these, any type of knitting needle having the same function may be used.

Figure 2:
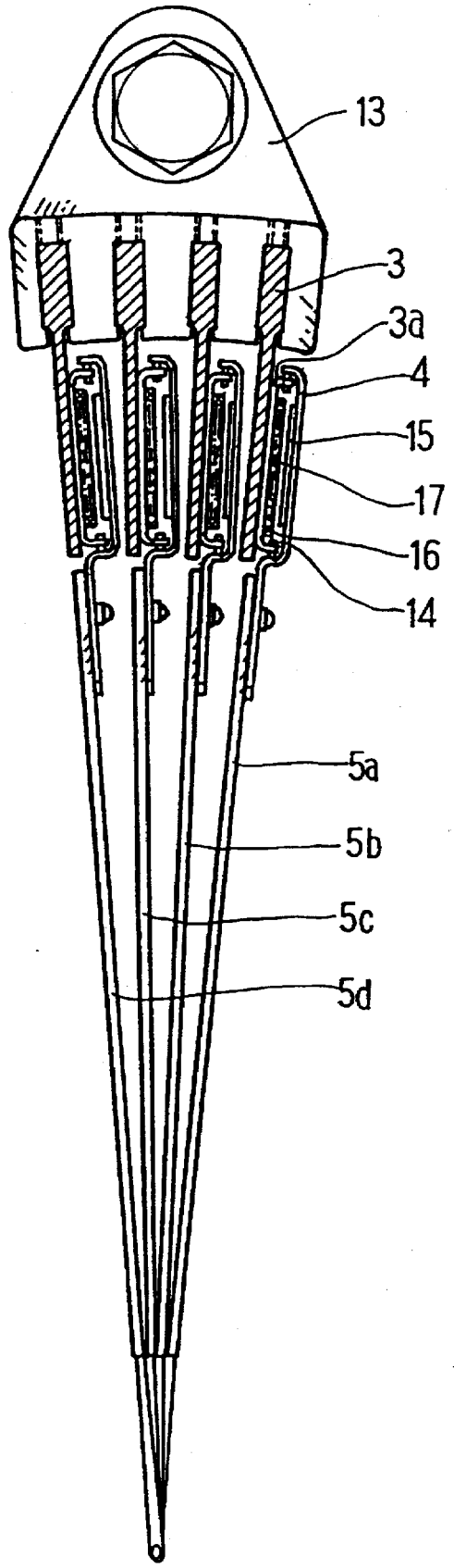
FIG. 2 is a sectional view showing an example in which four holding members including yarn guides form a set.

The construction of the driving section including the stators and movable elements 4 installed on the holding members 3 will now be described. FIG. 2 shows an example in which four holing members 3 are installed as a set. The holding members 3 are fixed in a holding member holder 13 at intervals which ensure a stable state. The numeral 14 denotes a bearing provided on a member **3*a* attached to the holding member 3, whereby the holding member 3 and the movable bodies 4 are disposed at fixed intervals. The numeral 15 denotes a field magnet disposed in the holding 3*a*; 16 denotes, an armature coil; and 17 denotes a Hall element, these components forming the stator of the linear motor, or the driving section of the linear motor which causes the movable element 4 to move linearly with respect to the movable body holding member 3**. In this case, the bearing may be replaced by a contactless bearing such as magnetic or compressed gas.

A yarn guide is fixed to the lower end of each movable element 4 by screw means. The yarn guides 5*a*, 5*b*, 5*c*, 5*d* are inclined with their front ends converging nesting as in the prior art. While the yarn guides have been shown fixed to the movable elements by set screw means, it is, of course, possible to construct portions of the yarn guides as movable elements (that is, portions of movable elements may be constructed as yarn guides).

Figure 3:
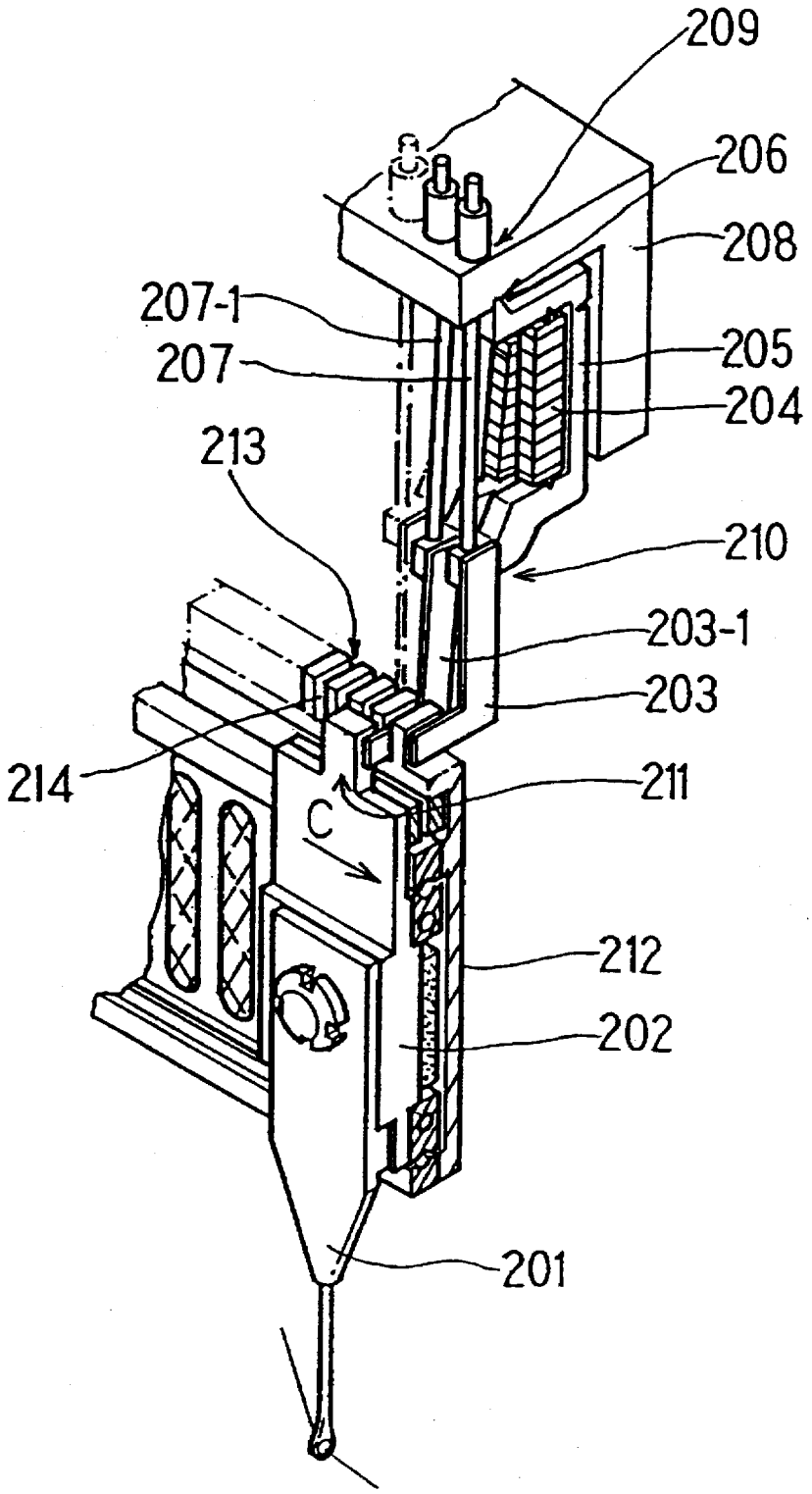
FIG. 3 is a perspective view of a patterning device showing an embodiment of the mechanism of a stop member for ensuring the amount of displacement of a movable body on a holding member.

A for the positioning of the yarn guides 5*a*, 5*b*, 5*c* and 5*d*, this is effected by a linear scale (not shown) which is one of the known positioning means, attached to the holing member 3; however, to make the positioning more reliable and to enable the movable elements 4 to follow rapid movement, a positioning mechanism shown in FIG. 3 is provided.

FIG. 3 is a perspective view showing an embodiment of a positioning mechanism using a stop member 203 to ensure the amount of displacement of the movable element 202 having a yarn guide 201 attached thereto. The stop member 203 uses a piezoelectric element 204 as a drive source. As the amount of displacement of the piezoelectric element 204 is very small, a device for amplifying the amount of displacement will now be described.

The piezoelectric element 204 is held by a U-shaped elastic body 205. The force point on the elastic body 205 is at 206, and the fulcrum is at the point 209 at which a wire 207 is fixed to a fixed stand 208. Further, the point of application is at 210 at which the stop member 203 is attached. When the piezoelectric element 204 receiving a signal extends, the elastic body 205 tries to have its open end further opened. On the other hand, the wire 207 operates to limit the amount of opening, with the result that the wire curves as shown at 207-1 to balance with the amount of opening of the elastic body 205. The stop member 203 advances as shown by the stop member 203-1, abutting against the raised portion 211 of the movable element 202 moving along the row of knitting needles in the direction of arrow C and thereby braking the same. The same operation takes place also when the movable element 202 moves in the direction opposite to the direction of arrow C. The activating position of the stop member is on the upper side of the holding member, but the stop member may, of course, act at any position on the yarn guide provided that it is in the range where there is no hindrance to the movement of the movable element 202.

The stop member 203 is closely received in a groove 214 in a comb 213 cut in one end of the stator 212 of the linear motor and is slid therein without any play.

In addition, the stop member could be operated under control by making use of mechanical means such as a dropper used in a Jacquard device.

What has so far been described is the arrangement of a first embodiment of the invention, and an example of the patterning method based on this arrangement will now be described with reference to FIG. 1.

The yarn guides 5*a*-1, 5*a*-2 and 5*a*-3 have pattern yarns 20-1, 20-2 and 20-3 respectively passed therethrough. Only these three will be described for the sake of convenience. Although a necessary number of yarn guides are movably attached to other movable body holding members 3 by the movable elements as movable bodies, these are omitted from the description for the sake of convenience.

The numeral 21 denotes a knitted fabric, and in the illustrated embodiment it is a curtain lace fabric. Usually, it is knitted such that the left-hand side in the figure is the lower portion of the curtain and right-hand side is the upper portion. The left-hand portion has a lower pattern which is taken charge of by those yarn guides disposed on the left-hand side of all holding members which have pattern yarns 20-1 passed therethrough, while the intermediate and upper patterns are taken charge of by those yarn guides which are disposed in the intermediate region and on the right-hand side of all holding members which have pattern yarns 20-2 and 20-3 passed therethrough, whereby entire patterning can be made.

The patterning device for a warp knitting machine is arranged such that patterning is made by moving the movable bodies having yarn guides for guiding pattern yarns along a guide path defined by the movable body holding member 3 in the direction of the row of knitting needles. If it is applied to various existing devices, such as Jacquard patterning device and weft yarn inserting device, it is possible to produce a more novel and gorgeous knitted fabric.

Further, in the case where a plurality of narrow laces are to be simultaneously knitted by the patterning device of the present invention, for example a 20-width-wise segmentable lace can be knitted to have different patterns for respective knitting widths. Further, it is also possible to provide locally wider laces and form a knitting such that narrow and wide laces are simultaneously present as they are mixed. Thus, the device of the present invention is useful for efficient production of small amounts of various kinds.

A description will now be given of an embodiment wherein a servomotor which is a kind of rotary motor constitutes at least part of a movable body, with a yarn guide attached thereto.

Figure 4:
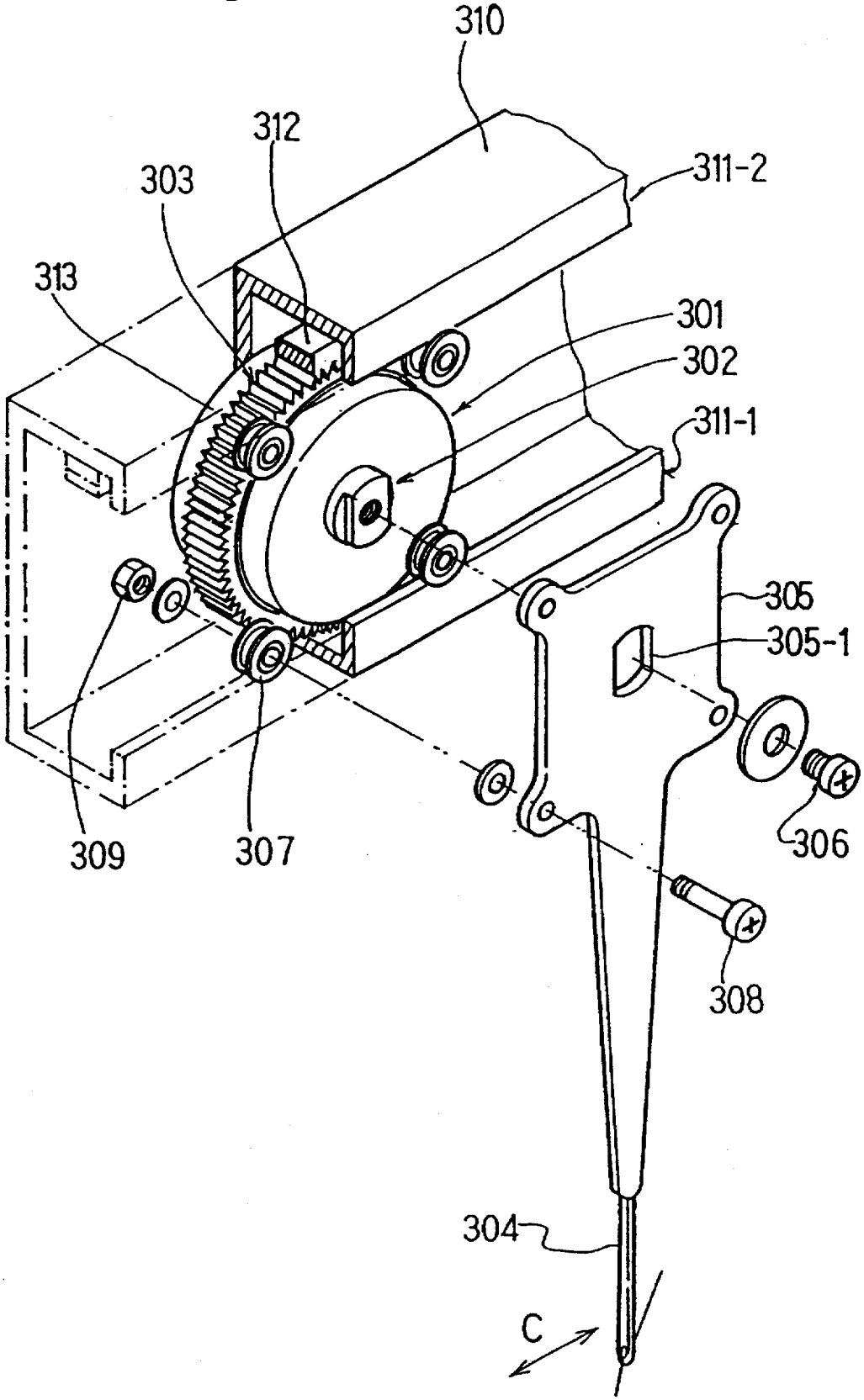
FIG. 4 is a developed perspective view showing an example of a patterning device with yarn guide individually driven by servomotors.

FIG. 4 is an exploded perspective view showing an example using a servomotor 301 of the outer ring rotation and shaft fixed type as part of the movable body. In the servomotor 301 used herein, the shaft 302 is fixed, while the outer ring which is the rotor is rotated under electronic control, with a pinion 303 meshing with the outer ring. A support plate 305 forming part of the guide point 304 is attached to the shaft 302 by a screw 306. The shaft 302 has in a portion thereof a boss formed by notching and an elongated opening 305-1 centrally formed in the support plate 305 is fitted on the boss without any danger of loosening. Further, grooved rollers 307 are rotatably attached to the four corners of the support plate 305 respectively by bolts 308 and nuts 309. The illustrated four grooved rollers 307 have their grooves closely fitted on a pair of rails 311-1 and 311-2 installed on the holding member 310 and disposed parallel with the row of knitting needles, so that they can roll on the rails. On the other hand, the aforesaid pinion 303 meshes with a rack 312 fixed on a portion of the inner surface of the holding member 310.

Therefore, when a signal is sent from the electronic control section to the servomotor 301, since the shaft 302 is supported for movement on the rails 311-1 and 311-2 by the support plate 305 of the yarn guide and the four grooved rollers 307, the torque on the pinion 303 causes the latter to move on the rails 311-1 arid 311-2 as the pinion meshes with the rack 312, with the result that the yarn guide 304 moves by a desired amount of displacement according to the rpm or rotary angle of the rotor in the direction of arrow C, i.e. along the row of knitting needles. The control of the amount of movement of the yarn guide 304 is made by the encoder 313 integrally attached to one side of the servomotor 301. Conductors and the like for transmission of signals are omitted from the illustration.

In the above embodiment, the servomotor used is of the outer ring rotation and shaft fixed type, but it may be of the outer ring fixed and shaft rotation type. In this case, the pinion may be attached directly to the shaft. Further, if it is structurally difficult to attach the pinion directly to the rotating part of the motor, power can be transmitted through a timing belt or the motor may be fixed while allowing the rack to slide, with the movable body attached to the rack, such arrangement being within the scope of the present invention. Driving the vertically moving divisional fall plates in the present invention is sometimes less advantageous than sliding the rack.

Figure 5:
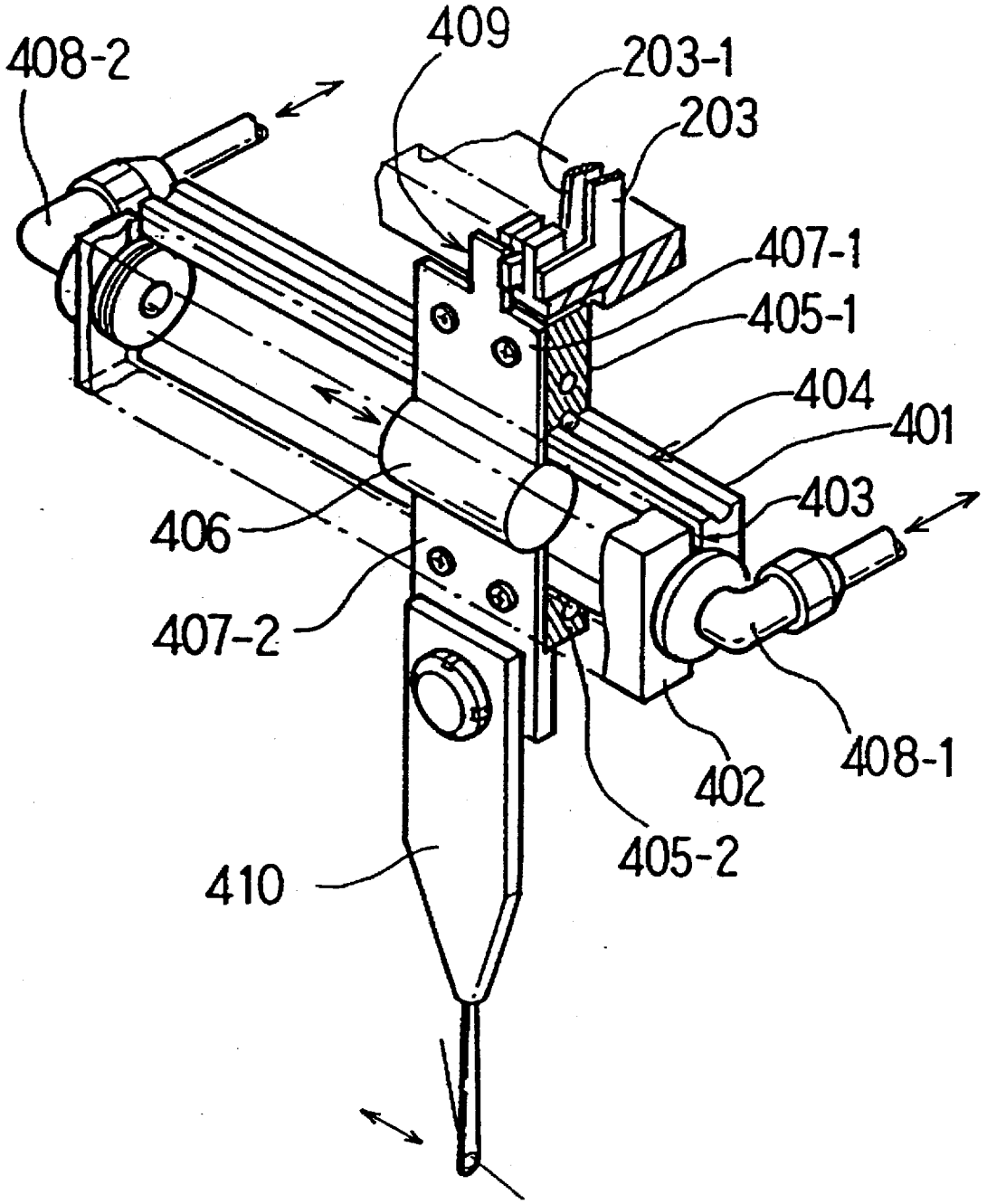
FIG. 5 is a developed perspective view showing an example of a patterning device with yarn guides individually driven by compressed fluid.

An embodiment in which compressed fluid is used as driving means for moving the movable body is shown in FIG. 5. As shown, cylinder halves 401 and 402 are opposed to each other with a slight clearance 403 defined therebetween to form a single cylinder. One cylinder half 401 is provided with linear guides 404, with linear bearings 405-1 and 405-2 disposed for rolling thereon. A piston 406 is disposed in the cylinder with a slight clearance for movement along the inner surfaces of the cylinder halves 401 and 402, the piston 406 having in a portion thereof support plates 407-1 and 407-2 fixed thereto, the support plates being secured to the linear bearings 405-1 and 405-2 by screw means. Spouts 408-1 and 408-2 for compressed air are attached to the opposite ends of the cylinder which is defined by the cylinder halves 401 and 402, for blowing compressed air into the cylinder to push the piston. Since the clearance 403 is defined between the cylinder halves 401 and 402, the compressed air would seem to be unable to effectively push the piston 406; however, as an example, if the clearance 403 is 1 mm for the inner diameter of 15 mm of the cylinder, it is possible to move the piston at the same time as the delivery of compressed air. However, the air pressure should be at least 3 kg/cm2.

The piston 406 can be quickly moved by feeding compressed air to the spout 408-1 or 408-2, as described above. The yarn guide is connected to this piston 406 to provide a movable body, and in order to make it agree with the knitting needle gauge and to stop it at an arbitrary position use is made of stop members 203 and 203-1 which are driven by electric means such as a piezoelectric element or mechanical means such as a Jacquard mechanism in the same manner as in the embodiment shown in FIG. 3, the stop members being adapted to act on a projection 409 formed on a portion of the support plate 407-1.

In FIG. 5, compressed air is fed from the spout 402 to move the piston 406 to the left in the figure, until it is acted on by the stop member 203-1 to stop at a predetermined position. On the other hand, a pattern guide 410 which is a yarn guide for guiding a patter yarn is fixed to the support plate 407-2 as by screw means, so that the pattern yarn can be moved to an arbitrary position and fed to a knitting needle. This embodiment is useful for feeding pattern yarns for narrow laces, but wide laces can be coped with by juxtaposing a plurality of devices of this embodiment. Generally, the distance which pattern yarns travel is at most 3 inches.

As for the means for driving the movable body, use may also be made of a supersonic linear motor using a combination of a piezoelectric or electrostrictive element and an elastic body and operating on the principle of strain. Usually, the length of pattern yarn fed to a row of knitting needles is at most 3–10 gauge for each course and hence the distance is about 4–15 mm even for a warp knitting machine whose needle density is 18 gauge/inch, and this distance may be traveled in about 0.03–0.05 sec. Since the supersonic linear motor produces friction between the driving body and the movable element, it is more advantageous to use as the positioning means a digital linear scale than a stop member.

Figure 6:
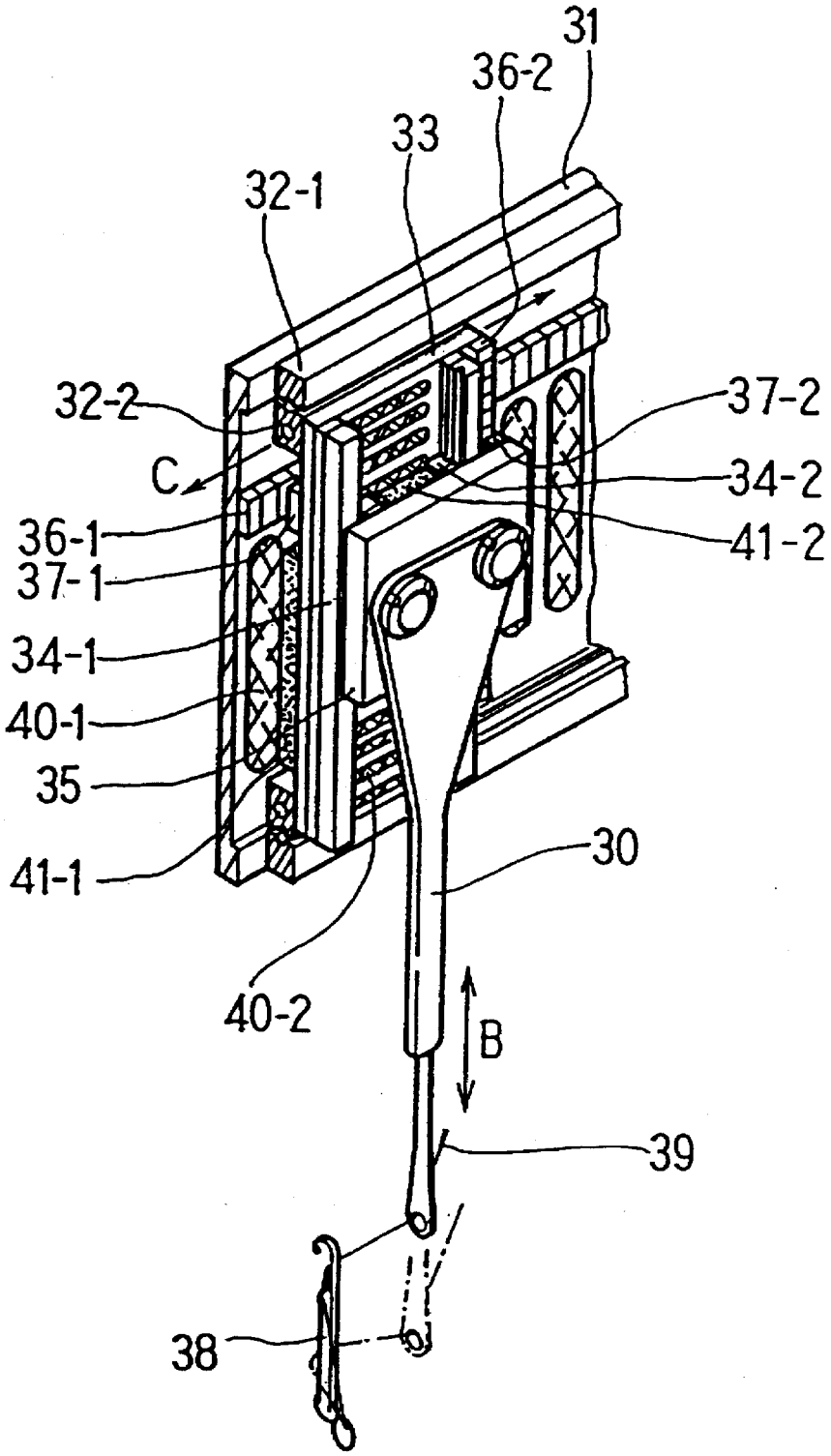
FIG. 6 is a perspective view of a patterning device showing an arrangement wherein yarn guides are moved in the direction of row of knitting needles and in a direction substantially at right angles with the direction of row of knitting needles.

A second form of the invention will now be described. FIG. 6 shows an embodiment wherein the knitting of a fall plate structure is made possible by a patterning device having a yarn guide 30 which is movable in a horizontal direction indicated by an arrow C and in a vertical direction indicated by an arrow B. The numeral 31 denotes a holding member having a portion which is constructed as the stator of a linear motor, the holding member 31 extending along a row of knitting needles, wherein a first movable element 33 is held by linear guides 32-1 and 32-2 for movement in a horizontal direction along the row of knitting needles. One surface of said first movable element 33 has a second movable element 35 attached thereto through linear guides 34-1 and 34-2 so that it can be vertically moved with respect to a portion of the row of knitting needles. Therefore, it follows that there are defined a horizontal guide path for moving the first movable element 33 along a portion of the row of knitting needles and a vertical guide path for moving the second movable element 35 toward a portion of the row of knitting needles. Further, the movable body includes the first and second movable elements.

This embodiment uses a dc linear motor and the positioning means comprises a magnetic resistance element 36-1 and a rubber magnet 37-1 magnetized with a predetermined pitch to produce a pulse signal, which are disposed on the side associated with the first movable element. As for the positioning of the second movable element 35, it is effected, as in the above, by a magnetic resistance element 36-2 and rubber magnet 37-2. As a movable element positioning mechanism, it is possible to utilize a stop member driven by electric means such as a piezoelectric element or mechanical means such as a Jacquard mechanism as in the case of the embodiment shown in FIG. 3.

The vertical movement of the yarn guide 30 has the following effects.

After a selected pattern yarn 39 alone has been overlapped on the hook portion of the knitting needle 38, the yarn guide 30 is lowered toward the row of knitting needles, whereby the pattern yarn 39 moves down such position to perform fall plate-like action, so that a fall plate structure can be formed: this means that the fall plate effect can be obtained locally on the knitting width, the effect being combined with the patterning effect provided by the yarn guide moving along the row of knitting needles, thereby providing a lace fabric having a novel external appearance.

Further, a lace fabric containing a fall plate structure and a lace fabric provided by the usual insertion knitting alone can be simultaneously knitted at different widths on a single knitting machine, a fact which is suitable for production of small amounts of various kinds.

Figure 7:
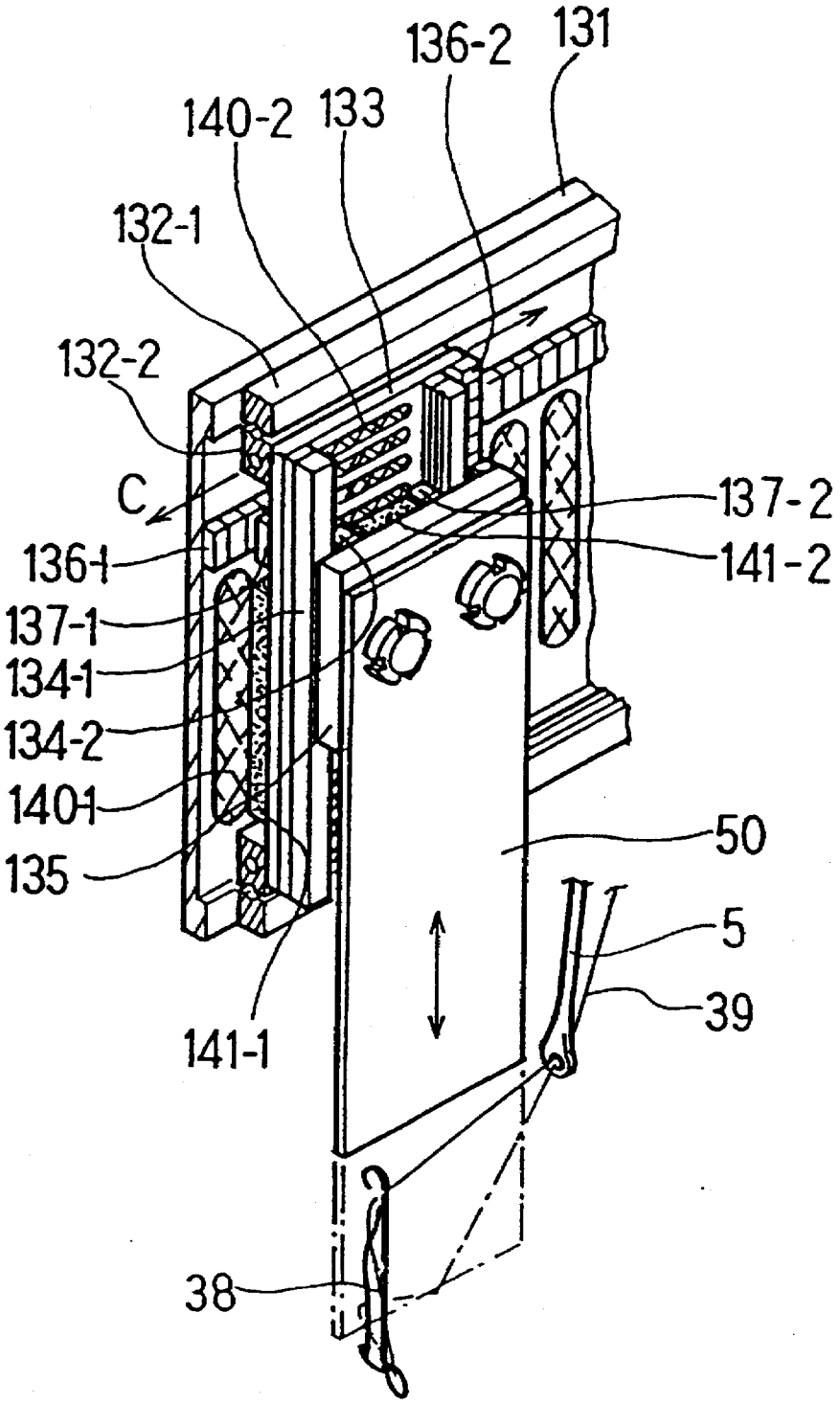
FIG. 7 is a perspective view of a patterning device showing an arrangement wherein divisional fall plates are moved in the direction of row of knitting needles and in a direction substantially at right angles with the direction of row of knitting needles.

FIG. 7 shows a device replacing the, yarn guide 30 in FIG. 6 by a divisional fall plate 50 corresponding to a portion of the row of knitting needles to serve as a fall plate device for knitting a pattern yarn 39 into a fall plate structure, the divisional fall plate being movable in a horizontal direction along the row of knitting needles and also in a vertical direction crossing the horizontal direction. The components corresponding to those shown in FIG. 6 are denoted by the corresponding numbers plus 100. The fall plate device of such arrangement is combined with an arrangement for moving the yarn guide in the direction of the row of knitting needles by the aforesaid movable body, thereby constituting a patterning device. With this arrangement, the divisional fall plate 50 moves the pattern yarn 39 overlapped on the knitting needle 38 by the yarn guide 5 to the knitting position for fall plate structure, whereby the knitting of the same fall plate structure as effected by the yarn guide 30 is effected at a desired position within the knitting width. When the divisional fall plate 50 is to be actuated, in order to ensure that the pattern yarn guide by the guide are suitably acted on by the divisional fall plates, the timing for movement with the yarn guide which is not acted on by the divisional fall plate can be freely changed by specifically varying the signal from the control section, and hence smooth fall plate knitting is effected.

As for the effect provided by the movement of the divisional fall plate in the horizontal direction along the row of knitting needles and its movement in the vertical direction (toward a portion of the row of knitting needles) crossing the horizontal direction, the fall plate action is disposed at necessary positions in necessary courses following the movement of each yarn guide for overlap alone, and, therefore, the vertical movement of the guide plate as shown in FIG. 6 becomes unnecessary, simplifying the linear device.

The dc linear motor used in the embodiments shown in FIGS. 6 and 7 has electromagnetic coils 40-1, 140-1, 40-2, 140-2 mounted on the stator side, and has four-pole magnets 41-1, 141-1, 41-2, 141-2 attached to the movable element side; therefore, basically, there is no need to transmit signals to the movable element, but conductors for the electromagnetic coils 40-2, 140-2 and magnetic elements 36-2, 136-2 are required to drive the second movable element 35, 135.

Figure 8:
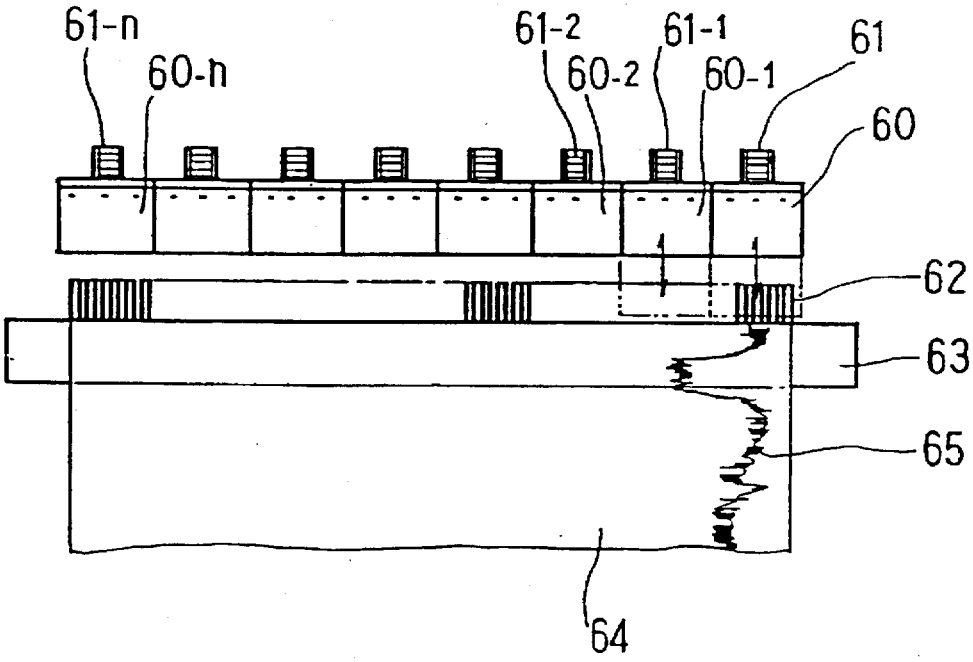
FIG. 8 is a partial front view of an embodiment of a patterning device in a warp knitting machine having a plurality of divisional fall plates into which a fall plate has been divided.

FIG. 8 shows an example in which in a warp knitting machine for effecting the knitting of fall plate structure by at least some of the pattern yarns introduced into yarn guides divisional fall plates corresponding to portions of the row of knitting needles are disposed along the row of knitting needles and a linear motor is used as a driving source for actuating each divisional fall plate.

The numeral 60 denotes divisional fall plates into which a fall plate has been divided to correspond respective portions of the row of knitting needles, the individual divisional fall plates being indicated by 60-1, 60-2 . . . 60-n. These divisional fall plates have linear driving bodies 61, 61-1 . . . 61-n respectively mounted thereon. The n divisional fall plates 60 are in the same plane along the row of knitting needles and adapted to fall to proper positions with respect to the row 62 of knitting needles to perform the fall plate action. The numeral 63 denotes a trick plate. The width of the individual divisional fall plates 60 is about 2–10 inches and it is arranged that part or all of the n divisional fall plates 60 can be selectively actuated.

When the pattern yarn 65 to form a design is to be fixed as a float pattern in a knitted fabric 64 produced in the manner shown in FIG. 8, this can be attained by suitably actuating the divisional fall plates 60 and 60-1 corresponding thereto, it being unnecessary to actuate the other divisional fall plates 60-2 . . . 60-n. Therefore, the divisional fall plates 60 can be selectively actuated in suitable courses without moving the divisional fall plates along the row of knitting needles, so as to efficiently knit a fall plate structure.

Figure 9:
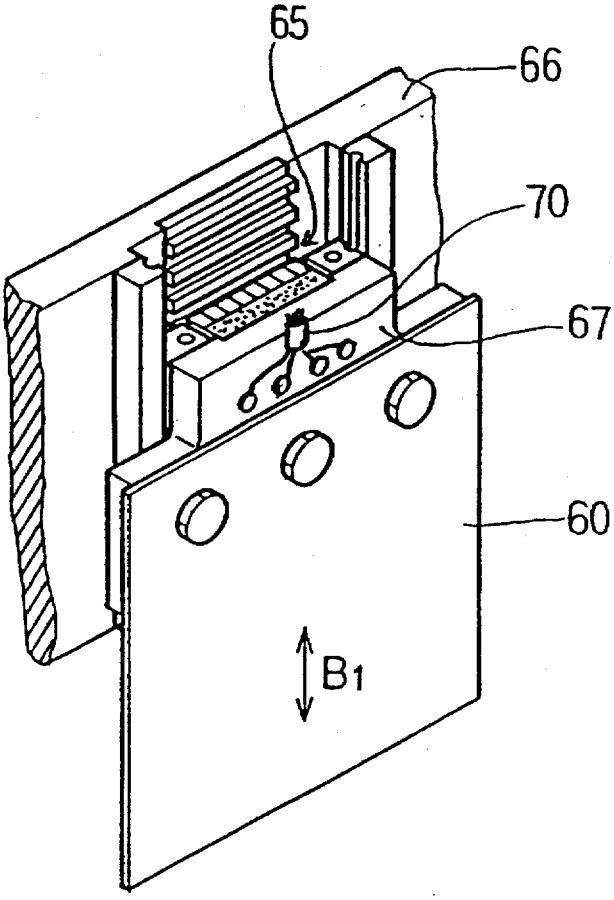
FIG. 9 is a perspective view showing a power source for a divisional fall plate in said patterning device.

FIG. 9 shows one driving source for the divisional fall plate described above, wherein the numeral 66 denotes a holding member; 67 denotes a movable body; 68 denotes a linear pulse motor; and 60 denotes a divisional fall plate. When a signal current is passed through a lead wire 70, the movable body 67 lowers in the direction of arrow B1, depressing the fall plate 60 fixed thereto to perform the fall plate action, and then it rises in response to a signal.

The knitted fabric which is produced by the patterning device of the present invention described above, e.g., the knitted fabric 21 shown in FIG. 1, has swing regions of different patterns, with a number of pattern yarns mixed and inserted in a single pattern width, which was impossible for a conventional yarn guide thus, a gorgeous pattern is produced which has no less pattern effect than that of a Jacquard lace. Further, it may be arranged that the fall plate actions for knitting a fall plate structure are individually provided by yarn guides or divisional fall plates, whereby it is possible to obtain a novel lace having a patterning effect provided by yarn guides to which a fall plate patterning effect is locally added.

Further, concerning the mechanism of the divisional fall plate arranged in the manner shown in FIG. 7 or FIGS. 8 and 9, it can be used not only in combination with an arrangement in which yarn guides for introducing pattern yarns are individually moved by movable bodies, but also in the case where in a warp knitting machine having yarn guides mounted on a pattern guide bar similar to a known one the knitting of a fall plate structure is effected by using at least part of the pattern yarns.

That is, in the case where the mechanism of the divisional fall plate is used, even if a pattern yarn is introduced by yarn guide similar to a known one, a divisional fall plate can be actuated at arbitrary knitting width positions on a plurality of simultaneously formed knitting widths and furthermore they can be actuated selectively in suitable courses; therefore, without having to use a large-scale device such as a conventional machine which actuate a whole fall plate over the entire width of the knitting machine, the knitting of fall plate structure can be effected by a simple device.

In addition, in the invention of the method and device utilizing a movable body having said divisional fall plate, as the drive means use may be made, as components, of a variety of electronically or mechanically controllable drive means such as not only said linear motor but also a rotary motor shown in FIG. 4, a compressed fluid as in FIG. 5, and means using a piezoelectric or electrostrictive element.

Further, In each embodiment of the invention described above, a case has been shown in which a control signal is electrically fed from a electronic control section to the drive means; however, besides this, it is also possible to embody the invention by providing a mechanical control section which controls by a mechanical sign utilizing a Jacquard or the like.

As described above, according to the patterning method and device for a warp knitting machine according to the invention, by individually controlling the movable bodies having yarn guides, the movement of the yarn guides can be freely controlled, thus providing a patterning region for pattern yarns corresponding to the number of yarn guides, enabling free patterning by which is comparable with the patterning effect provided by Jacquard control. Thus, without requiring a large-scale device such as a conventional one using a number of pattern guide bars, a large-scale, elaborate, colorful pattern can be made which it has been impossible to represent by various kinds of conventional Raschel lace fabrics or curtain fabrics.

Particularly, according to the method and device utilizing divisional fall plates, the knitting of fall plate structure is possible in addition to the patterning effect provided by yarn guides, further facilitating the knitting of transversely taken Raschel curtain fabrics, fall plate Raschel curtain fabrics and lace fabrics. Further, without requiring a large-scale device, the fall plate action is possible for each knitting width and can be selected for a necessary course, while reducing vibration and noise and enabling the knitting of fall plate structure to be efficiently performed.

What is claimed is:

1. A patterning device for a warp knitting machine having a row of knitting needles, the patterning device comprising:

at least one moveable body;

a yarn guide mounted on each of said at least one movable body for introducing a pattern yarn to said row of knitting needles to perform patterning;

a holding member extending in a direction of said row of knitting needles slidably supporting said at least one moveable body for movement along said holding member, said holding member being disposed to support said at least one moveable body such that said yarn guide is cooperative with said row of knitting needles;

driving means for moving said movable bodies along said holding member, said driving means including a linear motor having a stator and a movable element moveable relative to said stator, said stator being mounted to one of said holding member and said at least one moveable body and said moveable element being one of mounted to and formed in another one of said moveable body and said holding member; and said at least one moveable body being moveable along said holding member by said driving means over a range of displacement, required for a pattern, by signals from a control section driving said linear motor.

2. The patterning device for a warp knitting machine as set forth in claim 1 wherein said holding member holds a plurality of said at least one moveable body.

3. The patterning device for a warp knitting machine as set forth in claim 1 or 2 further comprising a stop means for displacing a stop member in a path of movement of said moveable member along said range of displacement to stop said moveable member at a predetermined position for patterning.

4. The patterning device for a warp knitting machine as set forth in claim 1 further comprising guide path and driving means for displacing said yarn guide to and from said row of knitting needles to perform a fall plate action for performing fall plate type knitting.

5. A patterning device for a warp knitting machine having a row of knitting needles, the patterning device comprising:

at least one moveable body;

at least one yarn guide for introducing a pattern yarn to said row of knitting needles to perform patterning;

said at least one moveable body having a divisional fall plate; and a guide path and driving means for displacing said divisional fall plate to and from said row of knitting needles to perform a fall plate action for knitting of a fall plate structure using said pattern yarn.

6. The patterning device for a warp knitting machine as set forth in claim 5 further comprising:

a holding member extending in a direction of said row of knitting needles slidably supporting said at least one moveable body for movement along said holding member, said holding member being disposed to support said at least one moveable body such that said divisional fall plate is cooperative with said row of knitting needles;

driving means for moving said at least one movable body along said holding member, said driving means including a linear motor having a stator and a moveable element moveable relative to said stator, said stator being mounted to one of said holding member and said at least one moveable body and said moveable element being one of mounted to and formed of another one of said at least one moveable body and said holding member; and said at least one moveable body being moveable along said holding member over a range of displacement, required for a pattern, by signals from a control section driving said linear motor.

7. A patterning device for a warp knitting machine as set forth in any one of claims 1 and 4 through 6, the patterning device further comprising one of an electronic control means and a mechanical control means for feeding control signals to said driving means.

8. A patterning device for a warp knitting machine as set forth in claim 5, the patterning device further comprising:

said at least one moveable body being a plurality of moveable bodies;

said guide path and driving means including:

holding means, including one of a holding member and a row of holding members, extending in a direction of said row of knitting needles, for supporting said plurality of moveable bodies along a length corresponding to a length of said row of knitting needles;

slidable support means on said holding means for slideably supporting said plurality of moveable bodies permitting individual movement towards and away from said row of knitting needles;

said holding means being disposed to support said plurality of moveable bodies such that said divisional fall plate is cooperative with said row of knitting needles; and driving means for moving said moveable bodies along said slidable support means, said driving means including a linear motor having a stator and a moveable element moveable relative to said stator, said stator being mounted to one of said holding member and said at least one moveable body and said moveable element being one of mounted to and formed of another one of said moveable body and said holding member; and said plurality of moveable bodies being disposed over a length of said holding means substantially equal to a length of said row of knitting needles.

9. A patterning device for a warp knitting machine as set forth in claim 5, said patterning device further comprising:

one or more second moveable bodies, other than said at least one moveable body provided with said divisional fall plate;

a yarn guide mounted on each of said second moveable bodies for introducing a pattern yarn to said row of knitting needles to perform patterning;

a holding member extending in a direction of said row of knitting needles slidably supporting said one or more second moveable bodies for movement along said holding member, said holding member being disposed to support said one or more second moveable bodies such that said yarn guide is cooperative with said row of knitting needles;

driving means for moving each of said one or more second moveable bodies, each of said driving means including a linear motor having a stator and a moveable element moveable relative to said stator, said stator being mounted to one of said holding member and said one or more second moveable bodies and said moveable element being one of mounted to and formed of another one of said one or more second moveable bodies and said holding member; and said one or more second moveable bodies being moveable along said holding member over a range of displacement, required for a pattern, by signals from a control section driving said linear motor.

10. A patterning device for a warp knitting machine as set forth in claim 9, said patterning device further comprising:

a second holding member extending in a direction of said row of knitting needles slidably supporting said at least one moveable body for movement along said holding member, said second holding member being disposed to support said at least one moveable body such that said divisional fall plate is cooperative with said row of knitting needles;

driving means for moving said at least one moveable body along said second holding member, said driving means including a linear motor having a stator and a moveable element moveable relative to said stator, said stator being mounted to one of said second holding member and said at least one moveable body and said moveable element being one of mounted to and formed of another one of said at least one moveable body and said second holding member; and said at least one moveable body being moveable along said second holding member over a range of displacement, required for a pattern, by signals from a control section driving said linear motor.

11. A patterning device for a warp knitting machine as set forth in claim 9, said patterning device further comprising:

said at least one moveable body being a plurality of moveable bodies;

said guide path and driving means including:

holding means, including one of a second holding member and a row of second holding members, extending in a direction of said row of knitting needles, for supporting said plurality of moveable bodies along a length corresponding to a length of said row of knitting needles;

slidable support means on said holding means for slideably supporting said moveable bodies permitting individual movement towards and away from said row of knitting needles;

said holding means being disposed to support said plurality of moveable bodies such that said divisional fall plate is cooperative with said row of knitting needles; and driving means for moving said moveable bodies along said slidable support means, said driving means including a linear motor having a stator and a moveable element moveable relative to said stator, said stator being mounted to one of said holding means and said at least one moveable body and said moveable element being one of mounted to and formed of another one of said moveable body and said holding means; and said plurality of moveable bodies being disposed over a length of said holding means substantially equal to a length of said row of knitting needles.

* * * * *